US012692681B2

(12) United States Patent
Li et al.

(10) Patent No.: US 12,692,681 B2
(45) Date of Patent: Jul. 28, 2026

(54) UNDERGROUND SPACE FRAME STRUCTURE AND CONSTRUCTION METHOD THEREOF

(71) Applicant: Shandong University, Jinan (CN)

(72) Inventors: Lianxiang Li, Jinan (CN); Xiuxi Che, Jinan (CN); Yefan Qiu, Jinan (CN); Chuhan Wang, Jinan (CN); Shangru Zhang, Jinan (CN)

(73) Assignee: Shandong University, Jinan (CN)

( * ) Notice: Subject to any disclaimer, the term of this patent is extended or adjusted under 35 U.S.C. 154(b) by 120 days.

(21) Appl. No.: 18/744,602

(22) Filed: Jun. 15, 2024

(65) Prior Publication Data

US 2025/0101704 A1 Mar. 27, 2025

(30) Foreign Application Priority Data

Sep. 25, 2023 (CN) ..... 202311238232.6

(51) Int. Cl.

| | |
|---|---|
| ***E02D 29/045*** | (2006.01) |
| ***E02D 5/30*** | (2006.01) |
| ***E02D 27/12*** | (2006.01) |
| ***E02D 31/02*** | (2006.01) |

(52) U.S. Cl.

CPC ..... *E02D 29/045* (2013.01); *E02D 5/30* (2013.01); *E02D 27/12* (2013.01); *E02D 31/02* (2013.01)

(58) Field of Classification Search

CPC ..... E02D 29/045; E02D 29/05; E02D 29/055; E02D 27/12; E02D 27/14; E02D 5/30; E02D 5/34; E02D 5/36

See application file for complete search history.

(56) References Cited

U.S. PATENT DOCUMENTS

2024/0076848 A1* 3/2024 Hua ..... E02D 15/04

FOREIGN PATENT DOCUMENTS

| | | | | |
|---|---|---|---|---|
| CN | 105862900 A | * | 8/2016 | ..... E02D 5/30 |
| JP | H10317374 A | * | 12/1998 | |
| KR | 20100062395 A | * | 6/2010 | ..... E02D 29/045 |

* cited by examiner

*Primary Examiner* — Amber R Anderson
*Assistant Examiner* — Stacy N Lawson
(74) *Attorney, Agent, or Firm* — Hemisphere Law, PLLC

(57) ABSTRACT

An underground space frame structure includes vertical support piles and multi-layer horizontal components. Each of the vertical support piles includes a pile body vertically disposed in a pile hole before excavating a foundation pit. The pile body includes an upper pile body and a lower pile body. The upper pile body is a rectangular body, and the lower pile body is a cylindrical body. An expansion section is located between the upper pile body and the lower pile body. A cross-sectional area of the expansion section is greater than a cross-sectional area of the upper pile body and a cross-sectional area of the lower pile body. The upper pile body, the expansion section, and the lower pile body are coaxially arranged from top to bottom in the pile hole. The multi-layer horizontal components are constructed from top to bottom.

9 Claims, 8 Drawing Sheets

UNDERGROUND SPACE FRAME STRUCTURE AND CONSTRUCTION METHOD THEREOF

TECHNICAL FIELD

The present disclosure relates to the field of building construction, and particularly to an underground space frame structure and construction method thereof.

BACKGROUND

Existing underground spaces (such as garages) are basically frame structures, which include rectangular columns, independent foundations, waterproof boards, and other structures. Column construction is completed by binding rebars, setting up formworks, and pouring concrete layer by layer after the independent foundations and the waterproof boards are completed.

A traditional underground space frame structure is constructed by multiple steps after the excavation of a foundation pit is completed. In a process of constructing the traditional underground space frame structure, firstly, a subbase is constructed and waterproof boards are set; secondly, independent foundation work is conducted, and then column formworks are erected and rebars are bound; and thirdly, concrete for the columns is poured, and the construction is carried out layer by layer. The process is complex and inefficient, and the process is done in sequence with many steps and has significant material waste.

SUMMARY

The present disclosure provides an underground space frame structure and construction method thereof. The construction method adopts a top-down construction sequence (i.e., a reverse construction sequence). The construction of support piles of the underground space frame structure is completed without a foundation pit, and constructions of beams and slabs are completed without a scaffold. The present disclosure greatly reduces resource investment, shortens a construction period, and improves safety.

A technical solution of the present disclosure is as follows:

an underground space frame structure, including: vertical support piles and multi-layer horizontal components connected to the vertical support piles; where the vertical support piles are arranged according to designed positions of the vertical support piles to form a column net;

each of the vertical support piles is a reinforced concrete bored pile; each of the vertical support piles includes a pile body vertically disposed in a pile hole defined before excavating a foundation pit; the pile body of each vertical support pile is composed of a reinforcement cage and concrete which are located in the pile hole; the pile body of each vertical support pile includes: an upper pile body, a lower pile body, and an expansion section located between the upper pile body and the lower pile body; the upper pile body of each pile body is a rectangular body, and the lower pile body of each pile body is a cylindrical body; a cross-sectional area of the expansion section is greater than a cross-sectional area of the upper pile body and a cross-sectional area of the lower pile body in each pile body; and the upper pile body, the expansion section, and the lower pile body of each pile body are coaxially arranged from top to bottom in that order in the pile hole and formed in one body; and the multi-layer horizontal components are configured to be constructed to connect a side of the upper pile body of each vertical support pile layer by layer from top to bottom during excavating the foundation pit.

In an embodiment, the multi-layer horizontal components include a waterproof board and at least one layer of horizontal beams and floor slabs; the waterproof board is located on a bottom surface of the foundation pit; a top surface of the expansion section of each pile body is flush with a top surface of the waterproof board; the expansion section and the lower pile body of each pile body are disposed below the top surface of the waterproof board; and the upper pile body of each pile body is disposed on the top surface of the waterproof board.

The at least one layer of horizontal beams and the floor slabs are connected to the side of the upper pile body of each vertical support pile.

In an embodiment, the expansion section of each pile body includes an upper frustum and a lower cylindrical body, the upper frustum and the lower cylindrical body are coaxially arranged, a diameter of the upper frustum gradually increases from top to bottom, a bottom diameter of the upper frustum is equal to a top diameter of the lower cylindrical body, and a thickness of the waterproof board is equal to a thickness of the upper frustum.

In an embodiment, in each pile body, a rectangle defined by a projection of a rectangular cross-section of the upper pile body on a top surface of the upper frustum is inscribed in a circle of the top surface of the upper frustum, and a circle defined by a projection of a circular cross-section of the lower pile body on the top surface of the upper frustum is inscribed in the rectangle defined by the projection of the rectangular cross-section of the upper pile body.

In an embodiment, the reinforcement cage of each pile body includes longitudinal rebars and transverse stirrups; and the longitudinal rebars are vertically arranged and continuously laid out along a length direction of the pile body.

In an embodiment, the longitudinal rebars are arranged in a rectangular shape in the upper pile body of each pile body according to the rectangular cross-section of the upper pile body; the longitudinal rebars are arranged in a circular shape in the lower pile body of each pile body according to the circular cross-section of the lower pile body; and transition parts of the longitudinal rebars are bent in the expansion section of each pile body.

In an embodiment, in each pile body, a central point of the rectangular cross-section of the upper pile body is taken as a center, the longitudinal rebars in the expansion section closer to an outside have greater inward bending degrees relative to the longitudinal rebars in the expansion section closer to the center; and the longitudinal rebars in the expansion section at tangent positions between the circular cross-section of the lower pile body and the rectangular cross-section of the upper pile body are not bent.

In an embodiment, the longitudinal rebars on a load-bearing side of each pile body and the longitudinal rebars on a side opposite to the load-bearing side of each pile body are strengthened.

In an embodiment, the transverse stirrups are densely arranged in a bottom zone of the upper pile body, a top zone of the lower pile body, and the expansion section in each pile body.

The present disclosure further provides a construction method for the underground space frame structure. The construction method includes:

S1: before excavating the foundation pit, using a drilling rig to construct each pile hole according to the designed positions of the vertical support piles;

S2: after obtaining each pile hole, placing the reinforcement cage into each pile hole, pouring the concrete into each pile hole to construct the vertical support piles, and forming the column net based on the vertical support piles;

S3: after concrete curing is completed, excavating the foundation pit at a designed position of the foundation pit;

S4: during excavating the foundation pit, constructing horizontal beams and floor slabs layer by layer on the upper pile bodies of the vertical support piles from top to bottom, and reserving a construction passage on the floor slabs;

S5: after the excavating of the foundation pit is completed, placing a waterproof board on a bottom surface of the foundation pit; where a top surface of the expansion section of each pile body is flush with a top surface of the waterproof board, the expansion section and the lower pile body of each pile body are disposed below the top surface of the waterproof board, and the upper pile body is disposed on the top surface of the waterproof board; and step S6: blocking the construction passage reserved on the floor slabs.

The present disclosure has the following beneficial effects.

The present disclosure replaces independent foundations with the expansion sections and lower pile bodies of the vertical support piles. By setting the vertical support piles on the ground and performing integrated efficient construction, load-bearing components (i.e., the vertical support piles) that integrates upper pile bodies and lower pile bodies are formed directly. The present disclosure realizes the integrated mechanical and rapid construction of the load-bearing components, and the present disclosure provides a novel vertical structure construction process for the assembly and industrial development of underground structures. Furthermore, the present disclosure is different from traditional underground structure construction (such as underground garage construction), the present disclosure changes a forward construction sequence of the traditional construction method which is performed from bottom to top to construct underground structures. The present disclosure adopts a reverse construction sequence that is performed from top to bottom to construct underground structures, and multi-layer horizontal components are connected effectively to form the underground space frame structure. In the underground space frame structure of present disclosure, there is no support during the underground space frame structure construction, which reduces costs of a lot of beams, slabs, scaffolds that are required in the traditional construction method. The present disclosure greatly improves construction efficiency and avoids safety hazards caused by high-rise formworks.

DETAILED DESCRIPTION OF EMBODIMENTS

To make the technical problems to be solved, technical solutions, and advantages of the present disclosure clear, a detailed description will be provided below in conjunction with the drawings and specific embodiments.

In an embodiment, as shown in FIG. 1 to FIG. 11, an underground space frame structure is provided. The underground space frame structure includes vertical support piles 100 and multi-layer horizontal components 200. The vertical support piles 100 are arranged according to their designed positions to form a column net.

Each of the vertical support piles 100 is a reinforced concrete bored pile. Each of the vertical support piles 100 includes a pile body 1 vertically disposed in a pile hole before excavating a foundation pit. The pile body 1 is composed of a reinforcement cage and concrete located in the pile hole.

Figure 1:
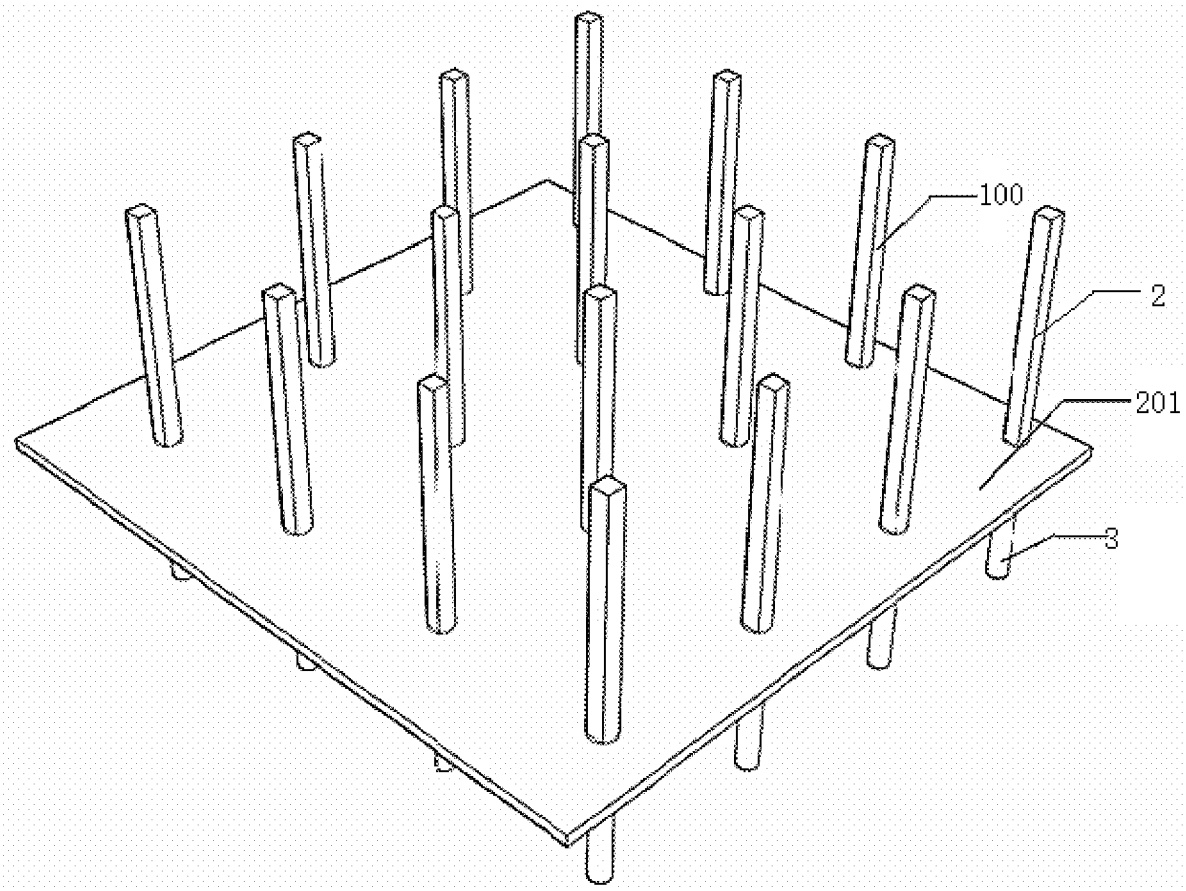
FIG. 1 illustrates a schematic view of an underground space frame structure (horizontal beams and floor slabs are omitted) of the present disclosure.
Figure 2:
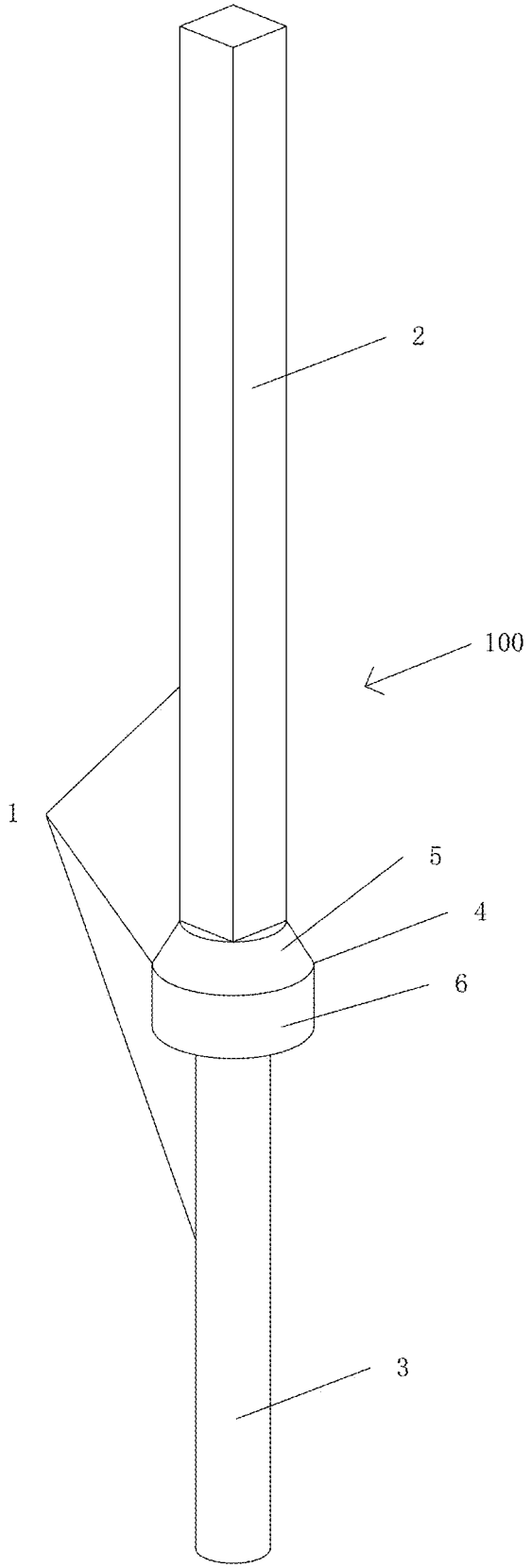
FIG. 2 illustrates a schematic view of a vertical support pile.

As shown in FIG. 2, the pile body 1 includes an upper pile body 2 and a lower pile body 3. The upper pile body 2 is a rectangular body, and a cross-sectional shape of the upper pile body 2 is rectangular. Preferably, the cross-sectional shape of the upper pile body 2 is square. The lower pile body 3 is a cylindrical body, and a cross-sectional shape of the lower pile body 3 is circular.

An expansion section 4 is located between the upper pile body 2 and the lower pile body 3. A cross-sectional area of the expansion section 4 is greater than a cross-sectional area of the upper pile body 2 and a cross-sectional area of the lower pile body 3.

The upper pile body 2, the expansion section 4, and the lower pile body 3 of each pile body 1 are coaxially arranged from top to bottom in that order in the pile hole and formed in one body.

Figure 3:
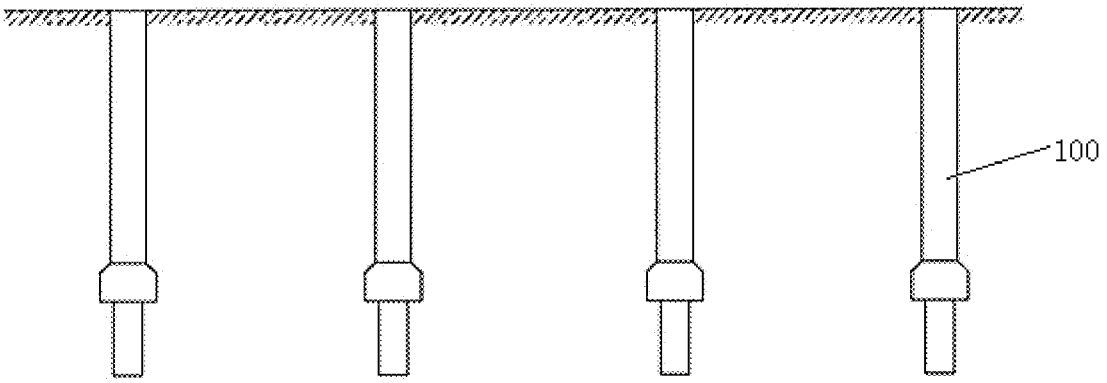
FIG. 3 illustrates a first schematic view of a construction process of the underground space frame structure of the present disclosure.
Figure 4:
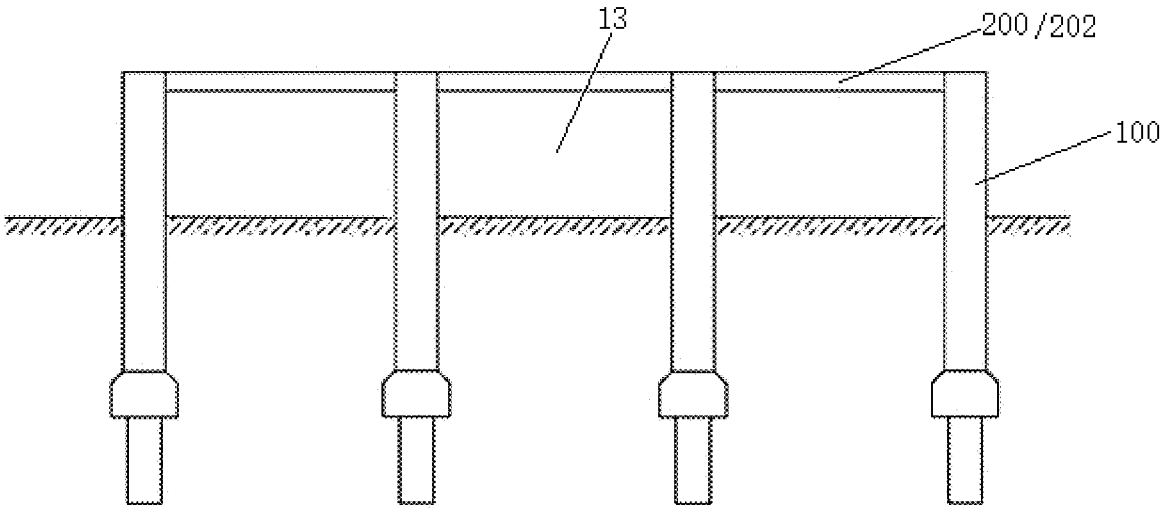
FIG. 4 illustrates a second schematic view of a construction process of the underground space frame structure of the present disclosure.
Figure 5:
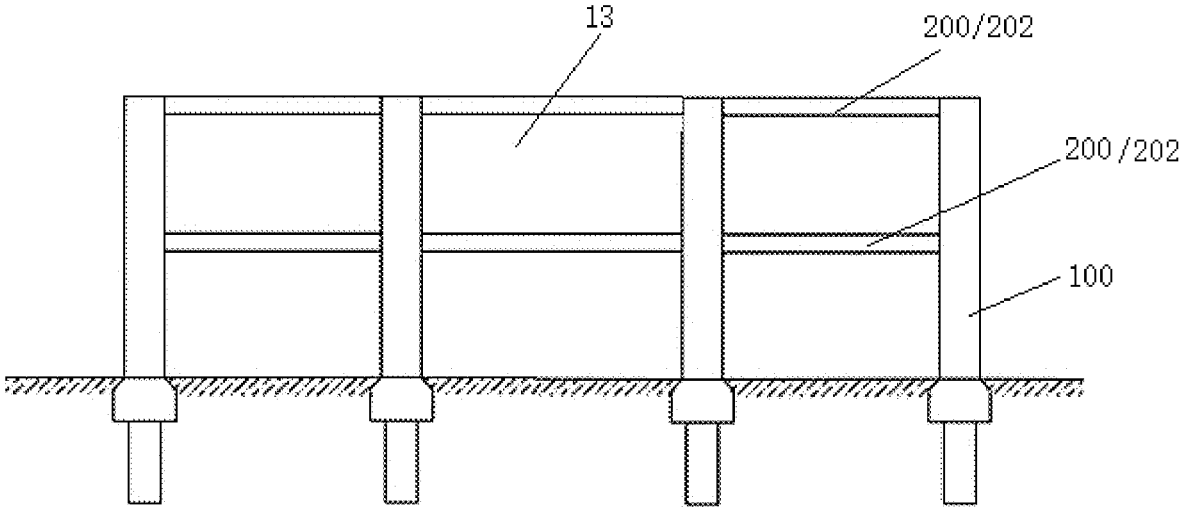
FIG. 5 illustrates a third schematic view of a construction process of the underground space frame structure of the present disclosure.

In a process of excavating the foundation pit, the multi-layer horizontal components 200 are configured to be constructed to connect the column net formed by the vertical support piles 100 layer by layer from top to bottom. The present disclosure drives piles into the ground to form multiple vertical supporting piles 100 having rectangular and circular cross-sections as load-bearing components. Then, excavation is carried out layer by layer, and horizontal components such as beams and floor slabs are constructed from top to bottom and are connected to the load-bearing components, thereby forming the underground space frame structure as shown in FIG. 3 to FIG. 5.

In the present disclosure, the reinforced concrete bored pile is divided into three parts to form the pile body 1 with a variable cross-section. The cross-section shape of the upper pile body 2 is rectangular, and its function is to serve as a column in the underground space, facilitating connection with the horizontal components 200 to form a whole for bearing vertical forces. The expansion section 4 serves as a bearing platform. The lower pile body 3 with the circular cross-section is under the expansion section 4. The construction of the vertical support piles 100 is convenient and fast, which can effectively save materials and construction time. The expansion section 4 and the lower pile body 3 are embedded under the foundation pit. The expansion section 4 and the lower pile body 3 serve as pile foundations, which can replace independent foundations. A novel underground space frame structure system is formed by effectively connecting the horizontal components 200 on each floor with vertical support piles 100.

The core of the present disclosure is to use the vertical support piles 100 that integrate columns and piles. The columns (i.e., the upper pile bodies 2) in the underground space have a rectangular cross-section, and the expansion sections 4 and the piles (i.e., the lower pile bodies 3) having a circular cross-section are inserted into the bottom of the underground space as the foundation of the vertical support piles 100. The present disclosure replaces independent foundations with the expansion sections 4 and lower pile bodies 3 of the vertical support piles 100. By setting the vertical support piles 100 on the ground and performing integrated efficient construction, load-bearing components (i.e., the vertical support piles 100) that integrates upper pile bodies 2 and lower pile bodies 3 are formed directly. The present disclosure realizes the integrated mechanical and rapid construction of the load-bearing components, and the present disclosure provides a novel vertical structure construction process for the assembly and industrial development of underground structures. Furthermore, the present disclosure is different from traditional underground structure construction (such as underground garage construction), the present disclosure changes a forward construction sequence of the traditional construction method which is performed from bottom to top to construct underground structures. The present disclosure adopts a reverse construction sequence that is performed from top to bottom to construct underground structures, and multi-layer horizontal components 200 are connected effectively to form the underground space frame structure. In the underground space frame structure of present disclosure, there is no support during the underground space frame structure construction, which reduces costs of a lot of beams, slabs, scaffolds that are required in the traditional construction method. The present disclosure greatly improves construction efficiency and avoids safety hazards caused by high-rise formworks.

The multi-layer horizontal components 200 include a waterproof board 201 and at least one layer of horizontal beams 202 and floor slabs. The waterproof board 201 is located on a bottom surface of the foundation pit. A top surface of the expansion section 4 is flush with a top surface of the waterproof board 201. The expansion section 4 and the lower pile body 3 are disposed below the top surface of the waterproof board 201. The upper pile body 2 is disposed on the top surface of the waterproof board 201. At least one layer of horizontal beams 202 and the floor slabs are connected to the side of each upper pile body 2 of the vertical support piles 100.

In the present disclosure, the expansion section 4 serves as a bearing platform and is easily connected to the waterproof board 201. The present disclosure utilizes the stiffness of the waterproof board 201 to reduce construction structures such as formworks, which greatly improves construction efficiency.

In an embodiment, as shown in FIG. 2, the expansion section 4 includes an upper frustum 5 and a lower cylindrical body 6. The upper frustum 5 and the lower cylindrical body 6 are coaxially arranged. A diameter of the upper frustum 5 gradually increases from top to bottom. A bottom diameter of the upper frustum 5 is equal to a top diameter of the lower cylindrical body 6.

Figure 6:
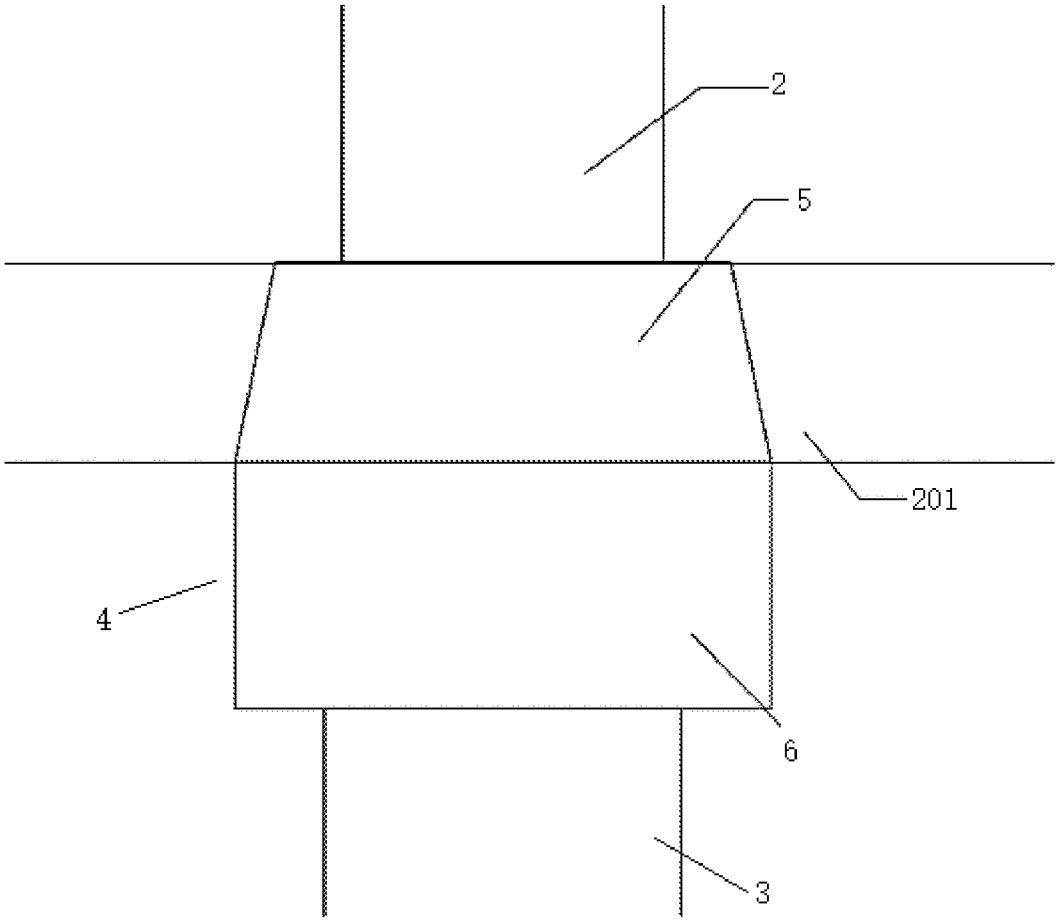
FIG. 6 illustrates a schematic diagram of the connection between a waterproof board and a vertical support pile.

Correspondingly, as shown in FIG. 6, a thickness of the waterproof board 201 is equal to a thickness of the upper frustum 5. Therefore, the upper frustum 5 is entirely located inside the waterproof board 201, and the lower cylindrical body 6 is located under the waterproof board 201.

Figure 10:
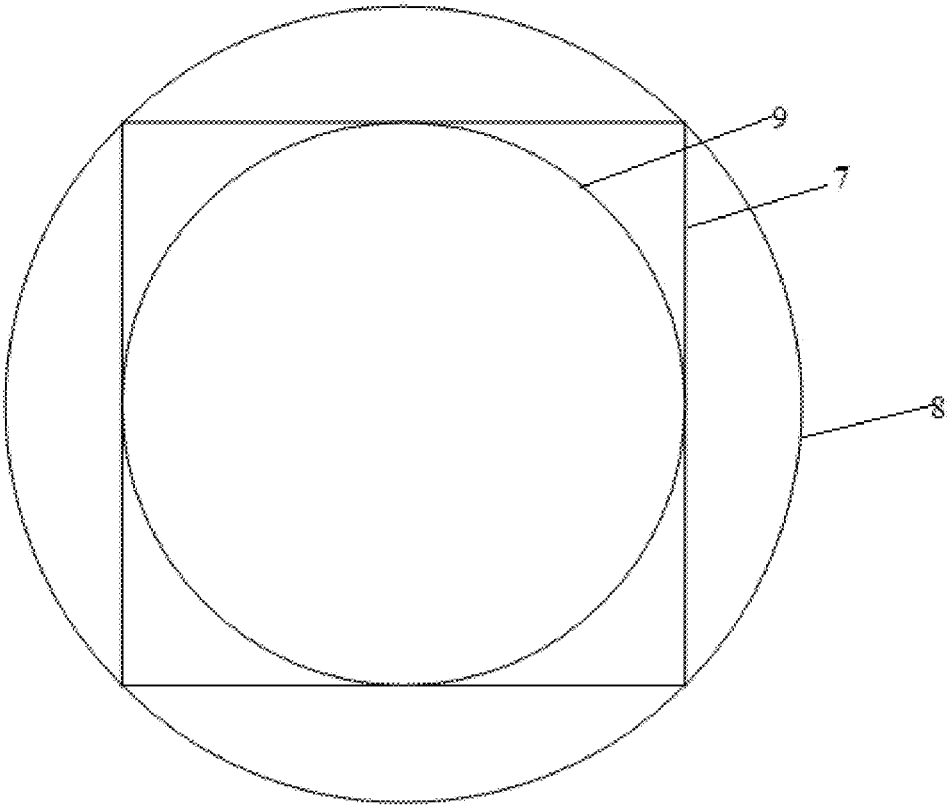
FIG. 10 illustrates a projection diagram of an upper pile body and a lower pile body on a top surface of the expansion section.

Specifically, as shown in FIG. 10, a rectangle 7 defined by a projection of the rectangular cross-section of the upper pile body 2 on a top surface of the upper frustum 5 is inscribed in a circle 8 of the top surface of the upper frustum 5. A circle 9 defined by a projection of the circular cross-section of the lower pile body 3 on the top surface of the upper frustum 5 is inscribed in the rectangle 7 defined by the projection of the rectangular cross-section of the upper pile body 2.

In the present disclosure, as shown in FIG. 7, FIG. 8, FIG. 9, and FIG. 11, the reinforcement cage includes longitudinal rebars 10 and transverse stirrups 11. The longitudinal rebars 10 are vertically arranged and continuously laid out along a length direction of the pile body 1. In the upper pile body 2, the lower pile body 3, and the expansion section 4, the number of the longitudinal rebars 10 is consistent. The number of the longitudinal rebars 10 and the number of the transverse stirrups 11 should be reasonably designed based on a mechanical calculation result of the engineering site.

Figure 7:
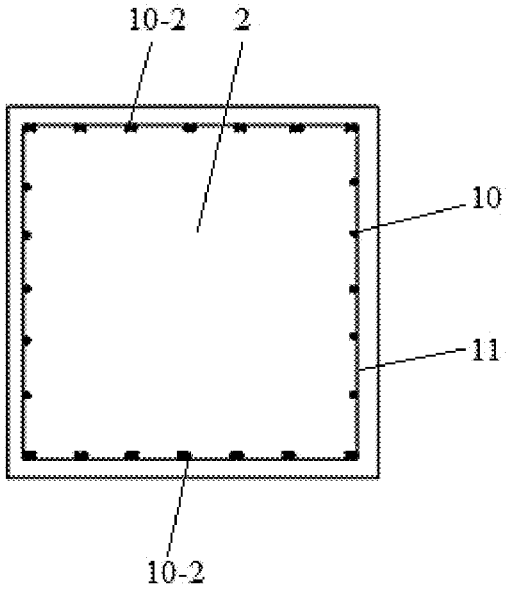
FIG. 7 illustrates a cross-section view of an upper pile body.
Figure 8:
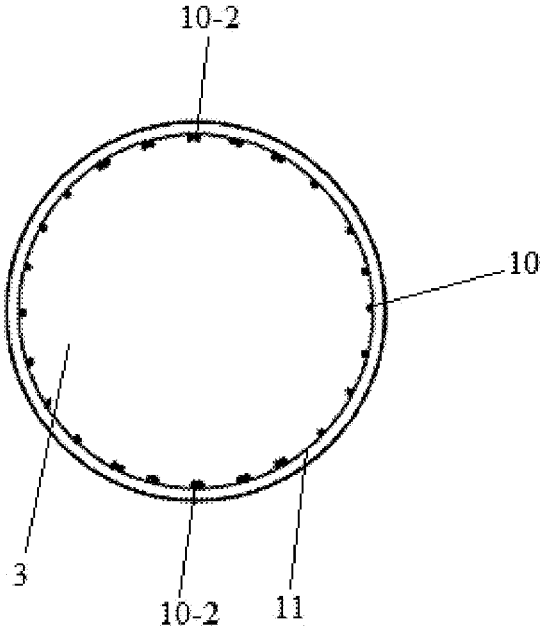
FIG. 8 illustrates a cross-section view of a lower pile body.
Figure 9:
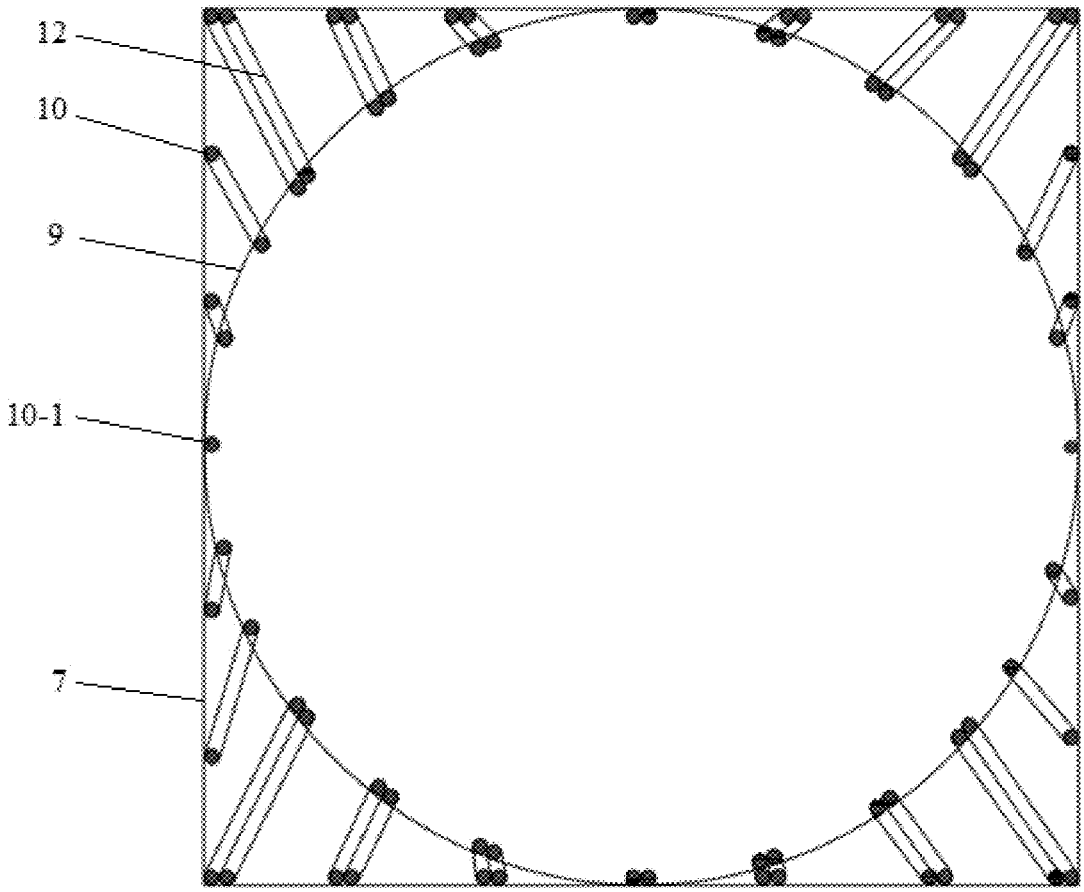
FIG. 9 illustrates a cross-section view of an expansion section.

As shown in FIG. 7, the longitudinal rebars 10 are arranged in a rectangular shape in the upper pile body 2 according to the rectangular cross-section of the upper pile body 2. As shown in FIG. 8, the longitudinal rebars 10 are arranged in a circular shape in the lower pile body 3 according to the circular cross-section of the lower pile body 3. As shown in FIG. 9, transition parts of the longitudinal rebars 10 are bent in the expansion section 4. As shown in FIG. 9, the shapes of the longitudinal rebars are changed to achieve a transition of the longitudinal rebars 10 from the upper pile body 2 to the lower pile body 3.

As shown in FIG. 9, in each pile body 1, a central point of the rectangular cross-section of the upper pile body 2 is taken as a center, the longitudinal rebars 10 closer to an outside (i.e., facing away from the center) have greater inward bending degrees. The longitudinal rebars 10-1 at tangent positions between the circular cross-section of the lower pile body 3 and the rectangular cross-section of the upper pile body 2 are not bent. Furthermore, the bending degrees of the longitudinal rebars 10 at four corners of the rectangular cross-section of the upper pile body 2 are the highest.

The longitudinal rebars 10-2 on a load-bearing side of each pile body and the longitudinal rebars 10-2 on a side opposite to the load-bearing side of each pile body are strengthened. As shown in FIG. 7 and FIG. 8, an upper side of each pile body 1 is the load-bearing side (the side that bears the bending moment), and thus the longitudinal rebars 10-2 on the upper sides and the lower sides of each upper pile body 2 and each lower pile body 3 are strengthened. Strengthening treatment of the longitudinal rebars 10-2 can be achieved by increasing diameters of the longitudinal rebars 10-2, or by increasing the density of the longitudinal rebars 10-2.

Figure 11:
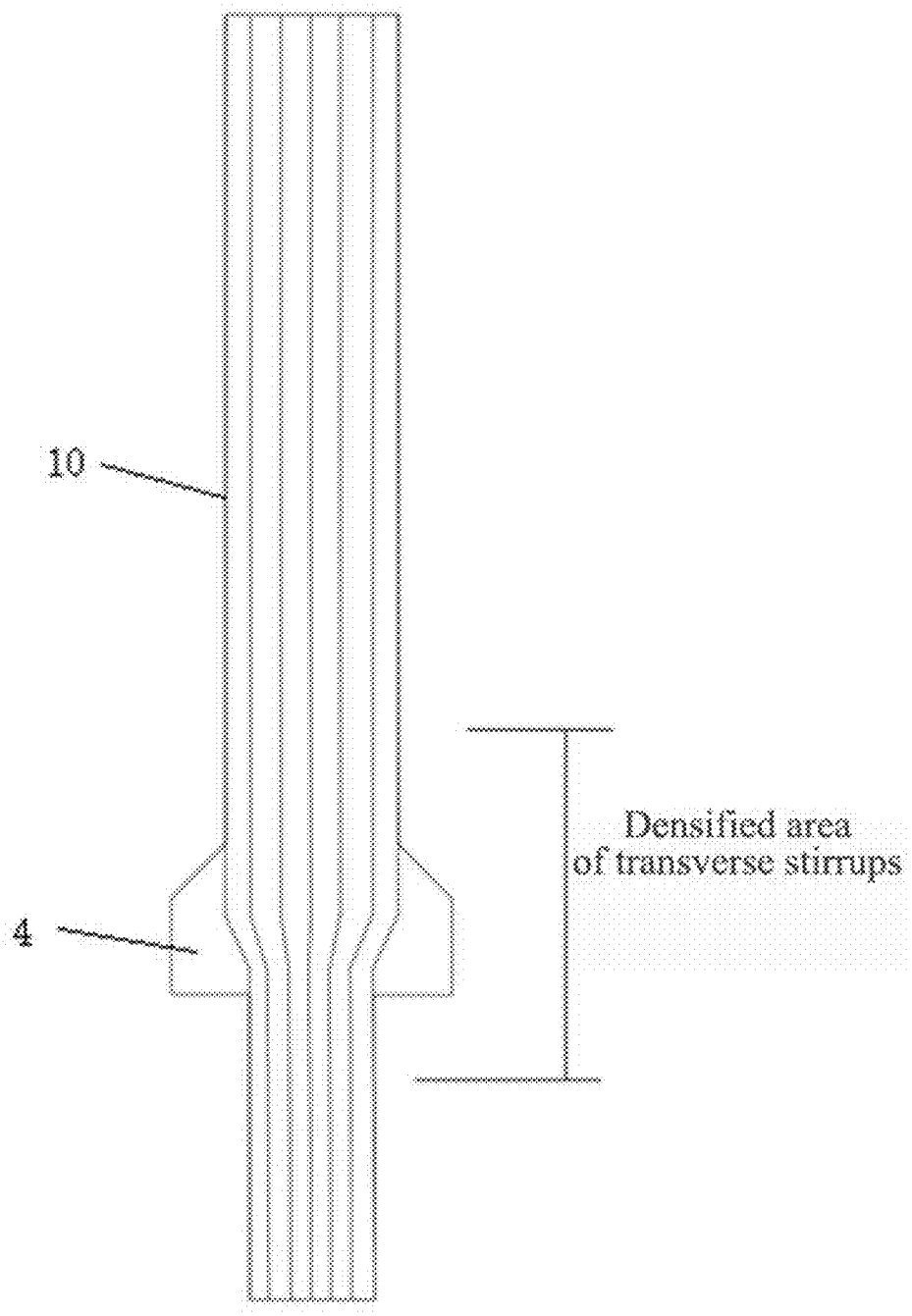
FIG. 11 illustrates a distribution diagram of longitudinal rebars and transverse stirrups.

As shown in FIG. 11, the transverse stirrups 11 are densely arranged in a bottom zone of the upper pile body 2, a top zone of the lower pile body 3, and the expansion section 4, thereby enhancing the load-bearing performance of the pile body 1.

In an embodiment of the present disclosure, a construction method for the underground space frame structure is provided. The construction method includes steps S1-S6.

In the step S1, before the foundation pit is excavated, a drilling rig is used to construct each pile hole according to the designed positions of the vertical support piles 100.

In the construction of the pile hole, according to the design requirements, a vertical support pile 100 has different cross-sections at different depths. A cross-section shape of an upper part of the pile hole is rectangular, and the upper part is used to construct the upper pile body 2. A cross-section shape of a lower part of the pile hole is circular, and the lower part is used to construct the lower pile body 3. An expansion part of the pile hole is between the upper part and the lower part are, and the expansion part is used to construct the expansion section 4.

In the present disclosure, a length and a side length of the upper pile body 2 can be adjusted according to engineering requirements. A length and a diameter of the lower pile body 3 can be adjusted according to engineering requirements. Diameters and a thickness of the expansion section 4 can be adjusted according to engineering requirements.

In the step S2, as shown in FIG. 3, after each pile hole is obtained, each reinforcement cage is placed into each pile hole, concrete is poured into each pile hole to construct vertical support piles 100, and the column net is formed based on the vertical support piles 100.

In the step S3, after concrete curing is completed, the foundation pit is excavated at a designed position of the foundation pit 13.

In the step S4, as shown in FIG. 4 and FIG. 5, during a process of excavating the foundation pit, horizontal beams 202 and floor slabs are constructed layer by layer on upper pile bodies 2 of the vertical support piles 100 from top to bottom, and the construction passage is reserved on the floor slabs.

When a construction passage needs to be reserved, some of the floor slabs may not be set for reserving the construction passage.

In the step S5, as shown in FIG. 6, after the excavating of the foundation pit is completed, a waterproof board 201 is placed on a bottom surface of the foundation pit. A top surface of the expansion section 4 is flush with a top surface of the waterproof board 201, the expansion section 4 and the lower pile body are disposed below the top surface of the waterproof board 201, and the upper pile body 2 is disposed on the top surface of the waterproof board 201.

In the step S6, the construction passage reserved on the floor slabs is blocked, and the underground space frame structure is completed.

The present disclosure starts the construction on ground before excavating the foundation pit 13. Firstly, the pile hole is obtained by drilling construction; secondly, the reinforcement cage is placed in the pile hole, and concrete is poured into the pile hole to construct the vertical support pile 100. After the vertical support pile 100 reaches preset strength, excavation is performed and a top floor of the underground structure (such as a garage) is started to be constructed, and beams and floor slabs are connected to each vertical support pile 100. After the beams and the floor slabs reach preset strength, the top floor of the underground structure is completed, and excavation is performed. After the excavation reaches a predetermined depth, a next floor of the underground structure is started to be constructed, i.e., the beams and the floor slabs of the next floor are constructed. Furthermore, in a process of constructing a bottom floor of the underground structure, a cushion layer and a waterproof board 201 are constructed.

The traditional construction method for underground structures adopts a forward construction sequence, which has the disadvantages of complex steps, low efficiency, and high resource investment. Compared with the traditional construction method for underground structures, the present disclosure adopts a reverse construction sequence, thereby improving construction efficiency and reducing costs of a lot of beams, slabs, scaffolds that are required in the traditional construction method. Furthermore, the present disclosure avoids safety hazards caused by high-rise formworks. The construction method of the present disclosure not only promotes the transformation of foundation pit engineering, but also promotes the development of basic theories and design methods. The present disclosure helps to promote the development of urban underground space structures. The present disclosure provides a new development concept and can promote the development of underground engineering.

The above embodiments are exemplary embodiments of the present disclosure. For those skilled in the art, improvements and modifications can be made without departing from principles of the present disclosure, and these improvements and modifications should also be included within a protection scope of the present disclosure.

What is claimed is:

1. An underground space frame structure, comprising: vertical support piles and multi-layer horizontal components connected to the vertical support piles; wherein the vertical support piles are arranged according to designed positions of the vertical support piles to form a column net;

wherein each of the vertical support piles is a reinforced concrete bored pile; each of the vertical support piles comprises a pile body; the pile body of each vertical support pile is composed of a reinforcement cage and concrete; the pile body of each vertical support pile comprises: an upper pile body, a lower pile body, and an expansion section located between the upper pile body and the lower pile body; the upper pile body of each pile body is a rectangular body, and the lower pile body of each pile body is a cylindrical body; a cross-sectional area of the expansion section is greater than a cross-sectional area of the upper pile body and a cross-sectional area of the lower pile body in each pile body; and the upper pile body, the expansion section, and the lower pile body of each pile body are coaxially arranged from top to bottom in that order and formed in one body; and the multi-layer horizontal components are connected to the vertical support piles by connecting the multi-layer horizontal components to a side of the upper pile body of each vertical support pile layer by layer from top to bottom.

2. The underground space frame structure as claimed in claim 1, wherein the multi-layer horizontal components comprise a waterproof board and at least one layer of horizontal beams and floor slabs; a top surface of the expansion section of each pile body is flush with a top surface of the waterproof board; the expansion section and the lower pile body of each pile body are disposed below the top surface of the waterproof board; and the upper pile body of each pile body is disposed above the top surface of the waterproof board; and the at least one layer of horizontal beams and the floor slabs are connected to the side of the upper pile body of each vertical support pile.

3. The underground space frame structure as claimed in claim 2, wherein the expansion section of each pile body comprises an upper frustum and a lower cylindrical body, the upper frustum and the lower cylindrical body are coaxially arranged, a diameter of the upper frustum gradually increases from top to bottom, a bottom diameter of the upper frustum is equal to a top diameter of the lower cylindrical body, and a thickness of the waterproof board is equal to a thickness of the upper frustum.

4. The underground space frame structure as claimed in claim 3, wherein in each pile body, a rectangle defined by a projection of a rectangular cross-section of the upper pile body on a top surface of the upper frustum is inscribed in a circle of the top surface of the upper frustum, and a circle defined by a projection of a circular cross-section of the lower pile body on the top surface of the upper frustum is inscribed in the rectangle defined by the projection of the rectangular cross-section of the upper pile body.

5. The underground space frame structure as claimed in claim 4, wherein the reinforcement cage of each pile body comprises: longitudinal rebars and transverse stirrups; and the longitudinal rebars are vertically arranged and continuously laid out along a length direction of each pile body.

6. The underground space frame structure as claimed in claim 5, wherein the longitudinal rebars are arranged in a rectangular shape in the upper pile body of each pile body according to the rectangular cross-section of the upper pile body; the longitudinal rebars are arranged in a circular shape in the lower pile body of each pile body according to the circular cross-section of the lower pile body; and transition parts of the longitudinal rebars are bent in the expansion section of each pile body.

7. The underground space frame structure as claimed in claim 6, wherein in each pile body, a central point of the rectangular cross-section of the upper pile body is taken as a center, the longitudinal rebars in the expansion section closer to an outside have greater inward bending degrees relative to the longitudinal rebars in the expansion section closer to the center; and the longitudinal rebars in the expansion section at tangent positions between the circular cross-section of the lower pile body and the rectangular cross-section of the upper pile body are not bent.

8. The underground space frame structure as claimed in claim 6, wherein the longitudinal rebars on a load-bearing side of each pile body and the longitudinal rebars on a side opposite to the load-bearing side of each pile body are strengthened.

9. A construction method for the underground space frame structure as claimed in claim 1, wherein the construction method comprises:

S1: before excavating a foundation pit, using a drilling rig to construct a plurality of pile holes according to the designed positions of the vertical support piles;

S2: after obtaining each pile hole, placing the reinforcement cage into each pile hole, pouring the concrete into each pile hole to construct the vertical support piles, and forming the column net based on the vertical support piles;

S3: after concrete curing is completed, excavating the foundation pit at a designed position of the foundation pit;

S4: during excavating the foundation pit, constructing horizontal beams and floor slabs layer by layer on the upper pile bodies of the vertical support piles from top to bottom, and reserving a construction passage on the floor slabs;

S5: after the excavating of the foundation pit is completed, placing a waterproof board on a bottom surface of the foundation pit; wherein a top surface of the expansion section of each pile body is flush with a top surface of the waterproof board, the expansion section and the lower pile body of each pile body are disposed below the top surface of the waterproof board, and the upper pile body is disposed above the top surface of the waterproof board; and step S6: blocking the construction passage reserved on the floor slabs.

* * * * *